United States Patent [19]

Goldfarb et al.

[11] Patent Number: 4,550,910

[45] Date of Patent: Nov. 5, 1985

[54] TOY TRACK PRESENTING INTERFERENCE TO PASSAGE OF TOY VEHICLES THEREON

[75] Inventors: Adolph E. Goldfarb, 1432 S. East Wind Cir., Westlake Village, Calif. 91361; Delmar K. Everitt, Woodland Hills, Calif.

[73] Assignee: Adolph E. Goldfarb, Westlake Village, Calif.

[21] Appl. No.: 578,860

[22] Filed: Feb. 10, 1984

[51] Int. Cl.[4] ..... A63F 9/14; A63H 18/08

[52] U.S. Cl. ..... 273/86 B; 238/10 R; 446/444

[58] Field of Search ..... 273/86 R, 86 B; 446/437, 444; 238/10 R, 10 E, 10 F

[56] References Cited

U.S. PATENT DOCUMENTS

| | | | |
|---|---|---|---|
| 3,413,754 | 12/1968 | Einfalt | 446/444 |
| 3,463,493 | 8/1969 | Guild | 273/86 B |
| 3,860,237 | 1/1975 | Cooper et al. | 238/10 R X |

FOREIGN PATENT DOCUMENTS

| | | | |
|---|---|---|---|
| 2164610 | 6/1973 | Fed. Rep. of Germany | 273/86 R |
| 669125 | 3/1952 | United Kingdom | 273/86 C |

*Primary Examiner*—Anton O. Oechsle

*Attorney, Agent, or Firm*—Romney, Golant, Martin & Ashen

[57] ABSTRACT

This track, particularly for use with electrically self-propelled vehicles, has various elements for interfering with vehicle passage. Different effects are obtained—amusing, fascinating, or enhanced competitive play with two or more vehicles. Most of the interfering elements are detachable, and usable in different combinations and arbitrarily selectable positions. Three element types are (1) bumps that redirect the vehicles, tending to make them go around curves in the track without moving to the sides; (2) small flooring sections operated (by levers) vertically through holes in the track floor, to variably influence the vehicles' passage along the track; and (3) a gate, with a releasable catch, for starting cars along the track simultaneously in a race.

12 Claims, 10 Drawing Figures

TOY TRACK PRESENTING INTERFERENCE TO PASSAGE OF TOY VEHICLES THEREON

BACKGROUND

1. Field of the Invention

This invention relates generally to toy tracks for electrically self-propelled toy vehicles, and more particularly to tracks which present different types of interference to passage of the toy vehicles 2. Prior Art Many toy tracks of different sorts are known, and some involve configurations which offer one or another type of interference to passage of vehicles on the tracks. By "interference" we mean to refer to anything that influences the velocity or direction of the vehicles Generally speaking these prior tracks tend to provide relatively unsubtle forms of interference—such as catapults, ramps, jumps, banked curves, turnarounds, and loop-the-loops—which require relatively little sophistication to appreciate. The appeal which these toy tracks have to users lies primarily in the spectacular effects produced, rather than in the users' ability to participate in the creation or control of these effects.

One exception to this last statement is in the classic toy-train-track switch, and other switchable track devices. Again, however, this type of interference produces distinctly unsubtle results: the vehicles go one way or the other (or derail and must be picked up and put back on the track).

There are some tracks for use with vehicles whose speed the user can control by controlling the power applied to its propulsion system—or, in some cases, by controlling the steering mechanism. In these cases the user participates in the creation of the interference effects somewhat indirectly. That is, the user generally can control the interaction between the velocity of the vehicle and the interfering element, but only to the extent that the interaction is controlled by the velocity.

Rather little has been done in the controlling of interference effects directly—and particularly in providing simple, inexpensive mechanisms for controlling such effects in a variety of different ways, and at a variety of locations on the track, and at a variety of times, and to a variety of extents, which the user can arbitrarily select.

The prior art has thereby neglected an area of particular enjoyment for users of toys, since the greatest enjoyment typically arises from the user's considered and measured participation in control of toys.

To the extent that development of sophistication in the understanding and exploitation of the physical phenomena involved can improve the user's ability to control the effects, the user's enjoyment is yet further enhanced—and so is the user's education, another well-recognized goal of toys. Prior-art toy tracks in general have not made much of these approaches.

SUMMARY OF THE DISCLOSURE

Our invention provides simple, inexpensive mechanisms for directly controlling toy-track interference effects in a variety of different ways, and at a variety of locations on the track, and at a variety of times, and to a variety of extents—all of which the user can arbitrarily select. The invention is particularly intended for use with electrically self-propelled vehicles whose propulsion and steering mechanisms are not controllable.

Our invention is intended to maximize the user's direct participation in the control of the interference effects, and thereby to involve the user's thought, planning, and dexterity—and the user's development of sophistication in the understanding and exploitation of the physical phenomena involved.

More specifically, the invention provides a toy track for use on a supporting surface, and for use with a self-propelled toy vehicle that has a plurality of front wheel means and that is adapted to operate on the track. By "wheel means" we refer to some means of providing rolling rotation about a generally transverse axis, to support the vehicle while the vehicle moves. These means of providing rolling rotation may be wheels, or the front portion of treads as on a tank, or a complete but shorter tread as on a front-end half-track vehicle, etc.—but generally speaking our invention is intended for operation with electrically self-propelled toy vehicles that have wheel means at both sides.

In one preferred embodiment the toy track includes an elongated track proper, which has a floor, and a wall at each side of the floor. At least some portions of the track are preferably curved horizontally so that vehicles when operating on the track must negotiate curves.

This preferred embodiment also includes a series of bumps on the floor of certain curved portions of the track. The bumps are extended in the direction transverse to the elongation of the track, and the bumps are adapted to redirect vehicles which strike them, by impeding the wheel means at the inside of the curve.

This particular principle will be more clearly understood from the detailed-description section of this document, in conjunction with the appended drawings. The basic idea, however, is this:

(1) the leading edge of each bump, being generally transverse to the long dimension of the track, is very generally radial relative to the curve in the track;

(2) if the vehicle is heading toward the outside of the curve—i.e., heading "outwardly" relative to a tangent to the curve—the wheel means that are on the side of the vehicle nearer the inside of the curve will generally strike each bump before the wheel means that are on the side of the vehicle nearer the outside of the curve strike that same bump; and (3) the propulsion system of the vehicle continues to push the latter wheel means forward into contact with the bump, while the former wheel means act almost as a pivot about which the vehicle rotates.

For purposes of clearer discussion, the wheel means that are on the side of the vehicle nearer the inside of the curve will be more briefly called the "inside wheel means", and the wheel means that are on the side of the vehicle nearer the outside of the curve will be called the "outside wheel means". Likewise the sides of the vehicle itself that are respectively nearer the inside and outside of the curve will be called the "inside side of the vehicle" and the "outside side of the vehicle".

Now using this verbal shorthand, we consider the situation in which the outside wheel means are not impeded (not having yet struck a particular bump), but the inside wheel means are impeded by that particular bump. We assume that the propulsion system of the toy vehicle continues to operate. Under these circumstances the outside wheel means will forwardly propel the outside side of the vehicle, while the bump impedes the inside side of the vehicle.

When one side of the vehicle is forwardly propelled but the other side of the vehicle is impeded, the vehicle naturally rotates. The rotation direction is such that the front end of the vehicle turns toward the impeded side. Consequently, if it is the outside side of the vehicle that is propelled and the inside side of the vehicle that is impeded, the front of the vehicle will turn toward the inside side of the vehicle—which is to say, toward the inside of the curve.

The net result is that the vehicle is turned in the same direction as the track is curving, as the vehicle proceeds along a curved portion of track where there are bumps. This action continues until the vehicle is facing the bump "square on", with the wheel means at both sides of the vehicle engaging the bump. Once lined up with both inside and outside wheel means addressing the bump, however, the vehicle is able to climb over the bump and proceed along the track.

The system can be configured, by suitable selection of the bump contours and dimensions, so that the vehicle tends to negotiate the curved portions of the track having the bumps without striking the wall at the outside of those curved portions.

We prefer to make the bumps discrete components, rather than integrally formed projections in the track floor The bumps are therefore positionable by the user of the toy track at selectable positions along the track. We accordingly make the floor of the track so that it defines some means for receiving and securing the bumps. These "means for receiving and securing the bumps" we here call "bump-receiving means". The floor of the track in fact defines a multiplicity of bump-receiving means, at a corresponding multiplicity of positions spaced along the track.

Consequently the user of the toy track may arbitrarily choose the selectable positions for the bumps, from among any of the multiplicity of positions where there are bump-receiving means.

Another preferred embodiment of our invention, like the first, has an elongated track with a floor. At least part of this floor is spaced above whatever supporting surface is used to support the track. The floor of this embodiment defines a plurality of holes; that is, there are two or more holes in the floor of the track.

This second embodiment also has a plurality of levers, each of which is pivotally mounted to the track and each of which has a handle extending laterally from the track for manipulation by a user. Each lever also extends into the region between the track floor and the supporting surface, and each lever is exposed at a corresponding one of the holes. (In other words, not all the levers need be exposed at the same hole.)

The second embodiment also has some means for providing auxiliary flooring pieces. These will be called "auxiliary flooring means". Auxiliary flooring means are fixed to or formed in each lever, and they are generally vertically movable by that lever through the corresponding hole. By working the lever, the user can move the auxiliary flooring means associated with that particular lever up and down through the corresponding hole—to vary the effective level of the auxiliary flooring means at that hole.

If desired, the auxiliary flooring means may be limited in travel, between a low level at which they are essentially flush with the rest of the track floor and a higher level at which they are essentially bumps in the track floor. If preferred, the auxiliary flooring means may be limited in travel between a low level at which they are essentially the bottoms of potholes in the track floor and a higher level at which they are essentially flush. Finally, the auxiliary flooring means may be permitted to range in height between bumps and potholes. In any event, the result is to variably affect the progress of a vehicle along the track, in dependence upon manipulation of the corresponding lever handle by a user.

We prefer to provide a toy track in which the lever handles of the second embodiment can be made to extend toward opposite sides of the track. That is, at least one of the handles extends to one side of the track, and at least one of the lever handles extends to the opposite side.

With this arrangement, a plurality of users at opposite sides of the track may competitively manipulate the handles, to competitively affect the progress of such a vehicle. More specifically, each user may have her or his own vehicle operating on the track, and may attempt to facilitate progress of that vehicle past the auxiliary flooring means under her or his control; and may attempt to deter progress of other users' vehicles past those auxiliary flooring means.

The second embodiment of our invention can be advantageously modified to form a third embodiment in which the track is modular. In this embodiment, the floor with holes is part of a first track segment—which is intended to be placed on a supporting surface such as a table, hard floor, rug, bed, etc.—and the levers are mounted to this track segment. The auxiliary flooring means likewise are associated with this track segment.

The third embodiment, however, also includes a multiplicity of other track segments having walls at both sides but having substantially no floor, so that a vehicle when in any of these "other" track segments operates substantially on the supporting surface. The third embodiment also has some means for interconnecting the "other" track segments with one another, and with the first track segment.

The result of making an embodiment of our invention in this way is that a user of the first track segment may choose to lay out his entire track set in such a way as to cause the toy vehicle, in negotiating the entire track, to pass along the first track segment and also to pass along a multiplicity of the "other" track segments—wherein the vehicle operates substantially on the supporting surface.

This particular option is very desirable, because it gives the user the benefits of the lever-controlled auxiliary flooring in one track segment, which of course is a relatively expensive article to make, but also gives the user the economy of the floorless track segments for the greatest fraction of the total track length. In other words, this system is calculated to make it possible to give the user a lot of fun for the price. In the toy industry this is an extremely serious matter.

A variant of the third embodiment is to include also as part of the track a multiplicity of additional track segments having floors as well as walls, and some means for interconnecting the "additional", the "first" and the "other" track segments so that the user who wishes to purchase additional floored segments is not limited to the floorless "other" segments.

In particular the interconnecting means mentioned in relation to the two variants of the third embodiment may be adapted to provide continuously adjustable but firmly secured vertical angles between the track segments. We prefer interconnecting means that are constructed as follows.

The first segment, and the additional segments if they are present, each have a respective floor, and at each side of the floor a respective wall. At each end of each segment is a half hinge, formed so that any two track segments may be connected together for relative rotation, by mating the half hinge at one end of one of the two segments with the half hinge at one end of the other two segments.

Each wall defines a curved slot at one end and a hole at the other. The slots and holes are disposed in such a way that when the half hinges of two segments are mated the two segments can be relatively rotated, vertically. In particular, the two segments can be rotated into a range of relative vertical angular positions in which the hole in the wall of one segment is aligned with a point along the curved slot in the other segment.

The interconnection means also include a number of bolts, each adapted to pass through one mutually aligned hole-and-corresponding-slot combination, and mating nuts adapted to be tightened on the bolts. The nuts and bolts in combination are used to lock each adjacent pair of segment walls in a particular relative vertical angular position An important detail is the use of a compliant washer between the mating track sections, since such a washer permits essentially continuous adjustment of angular relationship between adjacent sections. In prior modular tracks the angular adjustment has necessarily been by discrete increments.

A fourth embodiment of our invention is essentially a combination of the first two. The holes associated with the levers are made interchangeable with the "bump receiving and securing means". In other words, the bumps are made to fasten to the floor of the track by means of holes defined in the floor, and the user may use any of these same holes for operation of the levers and auxiliary flooring means. The levers are attachable by the user at essentially any of the holes, and the bumps are likewise fastenable by the user at any of the holes—except that generally there may not be enough room at any particular hole to do both.

Consequently the functionality of the track layout, as well as its general shape, is brought within the user's control—another instance of enhancing the user's participation or involvement in the toy, as previously mentioned. As will now be clear, the modular features introduced in the third embodiment mentioned above may be combined with the fourth embodiment.

A fifth embodiment of our invention is for use with two or more self-propelled toy vehicles adapted to operate on the track. This embodiment includes an elongated track—or at least a track segment—that is wide enough to accommodate a plurality of such toy vehicles side by side. This embodiment also includes a gate that is hinged to the track and is adapted to be secured in a generally upright position in which the gate restrains the vehicles from passage along the track. The gate is also adapted to hinge downwardly, to a generally flat position in which the vehicles can pass over the gate substantially without restraint.

In addition, fastened to the track are some means for securing the gate in the upright position and for releasing the gate to the flat position. These "securing and releasing means" are adapted to be manipulated by a user. The result of providing this embodiment of our invention is that the user, by manipulating the securing and releasing means in one way (to secure the gate in the upright position), can restrain a plurality of vehicles at the gate; and by manipulating the securing and releasing means in another way (to release the gate to the first position) can cause the plurality of vehicles that has been restrained to pass simultaneously over the gate.

The track of this fifth embodiment may include a wall at each side of the track, with the securing and releasing means mounted to at least one of the walls. The track may include a floor along which the vehicles pass, with the securing and releasing means mounted to the floor.

Any of the five embodiments already described may be combined with one or more vehicles, thereby in effect forming other embodiments of our invention—since the enjoyment of the toy track may be even further enhanced by providing self-propelled toy vehicles, and in particular electrically self-propelled toy vehicles, that are specifically shaped, dimensioned, and powered to work optimally with the track.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
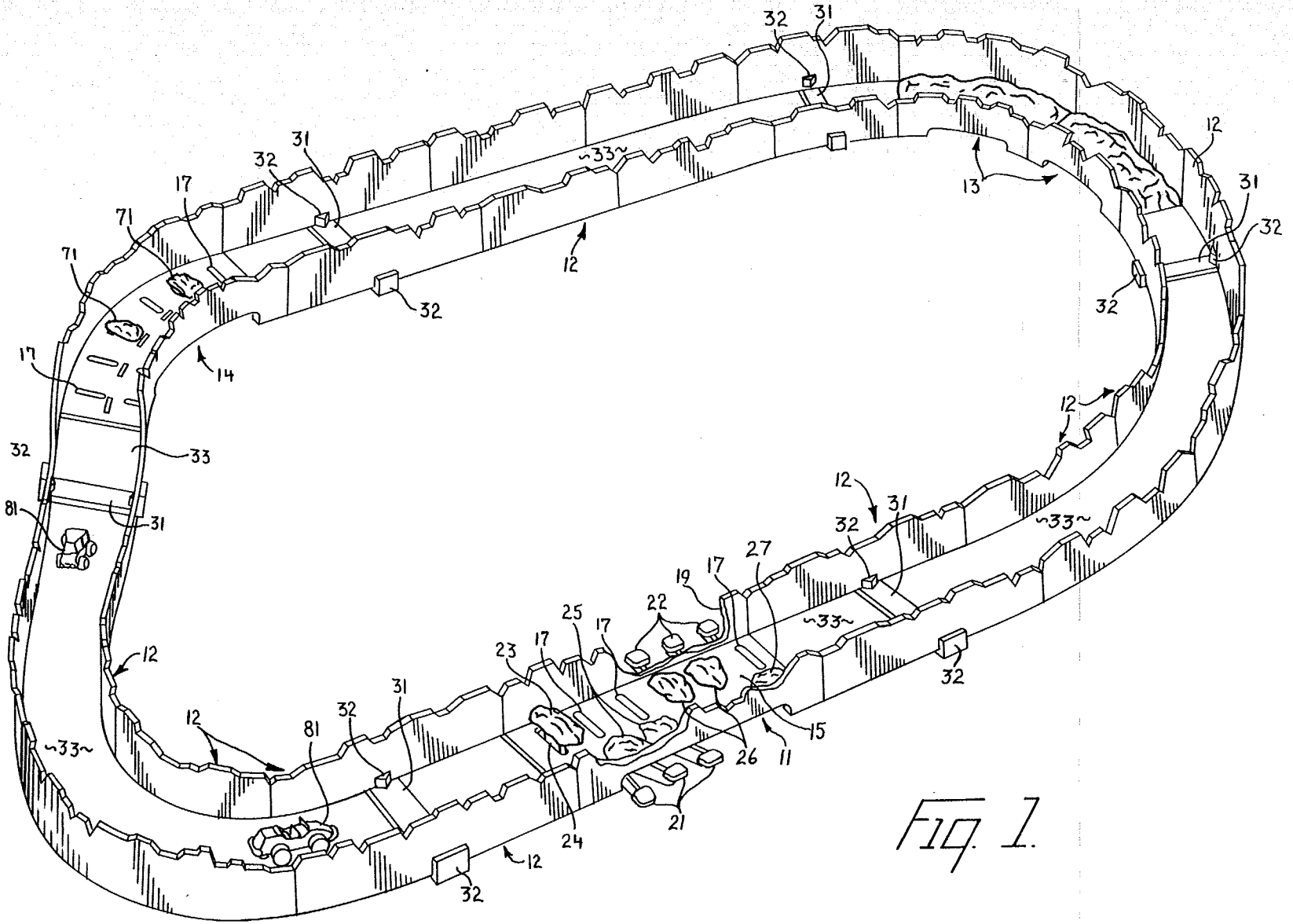
FIG. 1 is a general perspective like layout, partly broken away, showing one possible track arrangement using preferred embodiments of our invention. This drawing may be considered an illustration of the previously identified "third embodiment" and "fourth embodiment" of our invention.

Now with reference to FIG. 1, the single track segment 11 has a floor 15, walls 16 (the more remote wall being partly broken away at 19 for a clearer view of components behind that wall), and holes 17 defined in the floor. Visible between the walls 16 are auxiliary flooring means 23, 25, 26 and 27. Attached at the near side of the track segment 11 are control-lever handles 21 for three of these auxiliary flooring means (designated 23 and 25 in FIG. 1) and attached at the far side of the track segment 11 are control-lever handles 22 for three others (which are designated 26 and 27).

Interconnected with the ends of the first track segment 11 are other track segments 12, which as shown may be of the type having no floor. Some of these segments 12 do, however, have optional cross braces 31 for holding the floorless walls 12 generally vertical and generally an appropriate distance apart. Each cross brace has an upstanding clip 32 at each end for holding the respective walls.

Also interconnected with or among the track segments already described there may be additional segments 13 which do have floors, and these may include curved segments such as 14. Any of the floored sections may include vehicle-redirecting bumps 71 such as those shown on segment 14 in FIG. 1. If installed on a curved segment 14 as illustrated, the bumps 71 tend to cause the vehicles 81 traversing the track to pass around the curve of segment 14 without striking the side walls of that segment. If installed on a straight segment such as 11, the same bumps similarly will tend to bring the vehicles into alignment with the straight side walls 16 of that segment.

Various floored segments 11, 13 and 14 if linked together may be vertically angled relative to one another, to form arch-like structures, if the user so wishes. Such structures may pass over other segments if desired, to create figure-eight or other complex track layouts.

Figure 2:
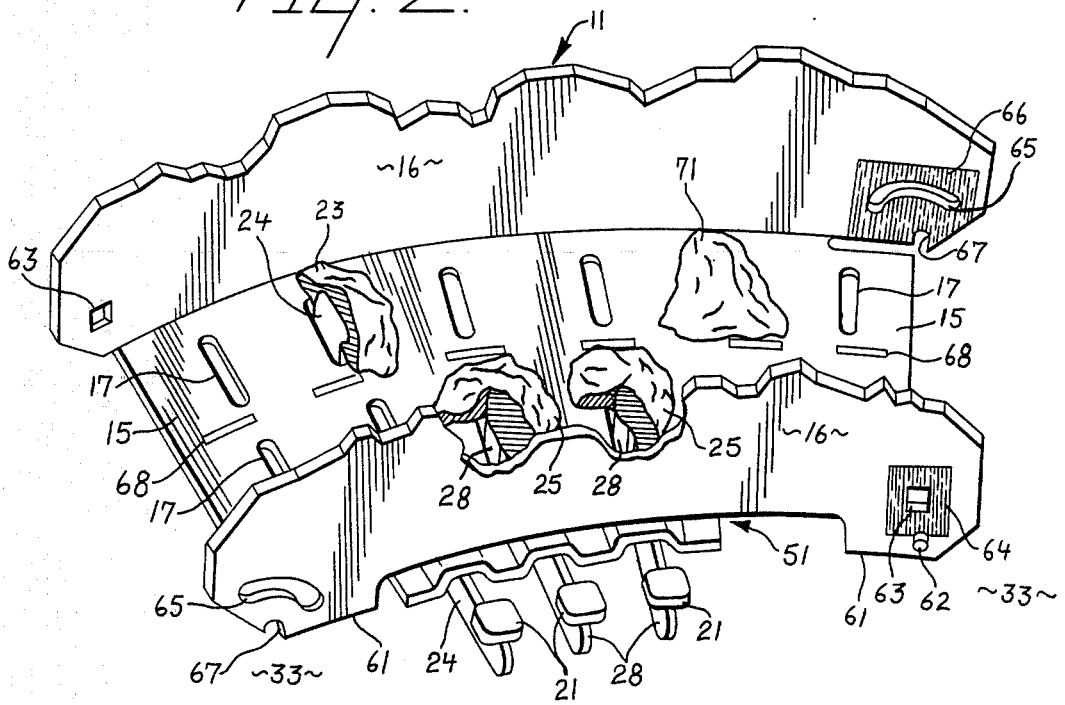
FIG. 2 is a perspective drawing of a single track segment according to certain preferred embodiments of our invention, taken from above and to one side of the track segment, and from a position slightly beyond one end of the track segment.

As shown in FIG. 2, the single segment 11 of FIG. 1 takes generally the form of a bridge, having stanchios 61 at the two ends that are in contact with the supporting surface 33, and having a raised intermediate portion that provides room for the auxiliary-flooring control levers 24, 28 between the track-segment floor 15 and the supporting surface 33. Holes 17 defined at preferably regular intervals along the track-segment floor 15 provide mounting holes for bumps such as that shown at 71 in FIG. 2, or provide access through-holes for the actuator ends of the auxiliary-flooring levers 24, 28 as illustrated; as indicated in the drawing, some of the holes can serve one of these functions while others of the holes serve another of these functions.

Another series of holes 68 is provided for attachment of an optional vertical center-divider strip (not illustrated), which has mating tabs in its bottom edge for insertion into the holes 68.

Figure 3:
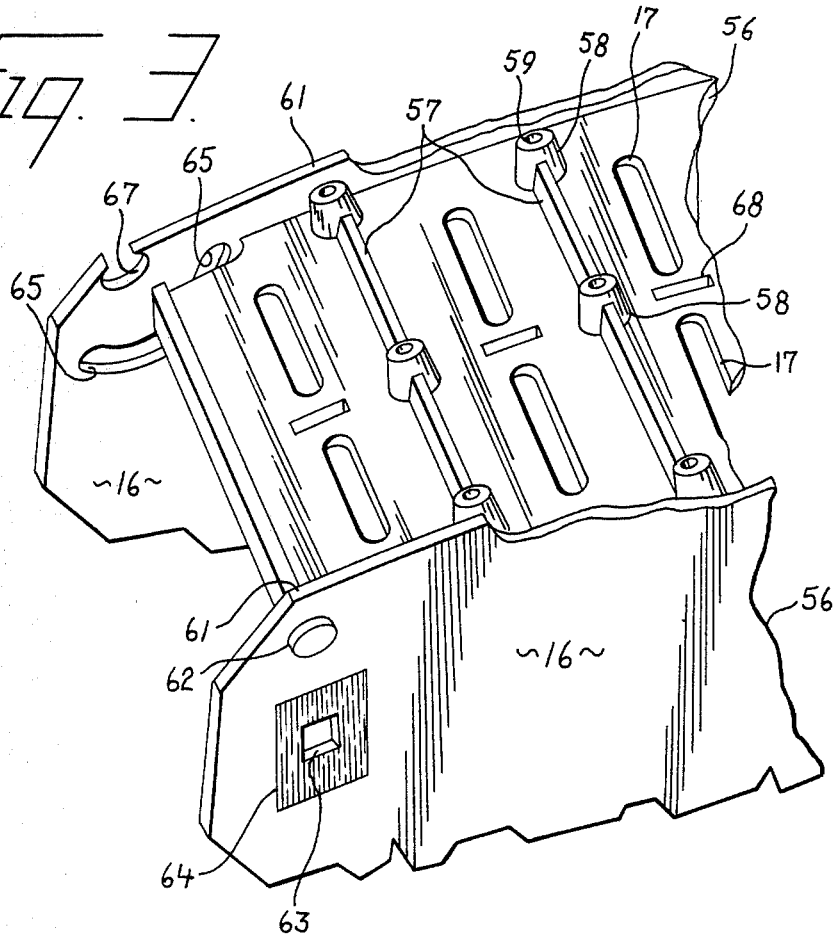
FIG. 3 is a perspective drawing of the FIG. 2 track segment, taken from below and to one side, and from a position slightly beyond one end.

As shown in FIG. 3 (which is cut away at 56 to permit a more-enlarged view of the details), the underside of the FIG. 2 track segment has reinforcing ribs 57 extending across the full width of the track. Formed as part of the ribs 57 are mounting bosses 58, each with an initially untapped vertical screw hole 59 at its center. These bosses 58 and holes 59 are for attachment of other accessories such as the mounting bracket 51 (FIG. 2) for the auxiliary-flooring control levers.

In each end of the track segment 11—and in each end of every one of the several different kinds of segments previously discussed (and suggested in FIG. 1)—there is a half hinge that is adapted to mate with the half hinge of any other segment. Each half hinge consists of a round pin 62, projecting in the outboard direction from the outside surface of the outer wall 16 at one side of the track, and a matching round hole 67 defined in the outer wall 16 at the opposite side of the track.

As shown, the hole 67 may be formed as an open groove, but the solid round surface of the interior of the hole should encompass very slightly more than a half circle —that is to say, it should be more than 180 degrees around—to present an interference fit to the mating pin of the adjacent track segment. This arrangement makes assembly easy, but prevents the pins from falling out of the mating holes.

Also defined in the side walls 16 are a square hole 63 through one side wall and a curved slot 65 through the other side wall. The slot 65 curves in a circular locus about the centerline of the round hole 67. The center of the square hole 63 is spaced the same distance from the centerline of the round pin 62 as the centerline of the slot 65 is spaced from the centerline of the round hole 67. Consequently the square hole 63 of each segment is alignable with the curved slot 65 of any adjacent segment, when the pins and round holes are mated, provided only that the two track segments are rotated to a suitable angle within the intended range of adjustment of the parts.

Also defined in the side walls 16 are multiple grooves, serrations or roughened areas 63 and 66 surrounding the square hole 63 and curved slot 65 respectively. These areas 63 and 66 face each other when the track segments are suitably assembled, and help provide traction for maintaining adjacent segments at the selected mutual angles.

Figure 9:
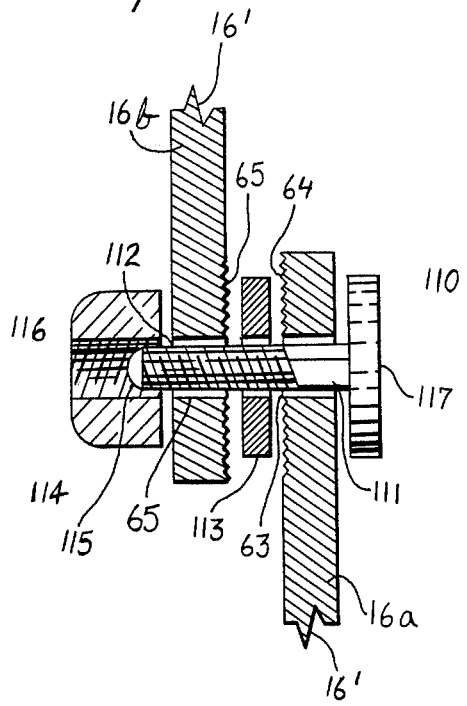
FIG. 9 is a plan view, mostly in section, showing the interconnecting means of the previously discussed "third embodiment".

FIG. 9 shows assembly details for side walls **16*a* and 16*b* (both cut off at 16' in the drawing to permit ample scale). The assembly makes use of a special bolt 110 that is formed with a head 117 and a square shank section 111 just adjacent the head, in addition to a threaded portion 112. The square shank 111 is inserted into the square hole 63 (corresponding to a square hole 63 in FIGS. 2 and 3), so that the threaded section of the bolt passes through a soft washer 113 and through the curved slot 65 (corresponding to a curved slot 65 in FIGS. 2 and 3) into a nut 114**.

The compliant washer 113 cooperates with the roughened surfaces 64 and 65 (see FIGS. 2, 3 and 9) to very firmly lock the adjacent walls **16*a* and 16*b*** at whatever angle (within the adjustment range) the user selects. This combination of components provides continuous adjustment but very secure locking.

Figure 4:
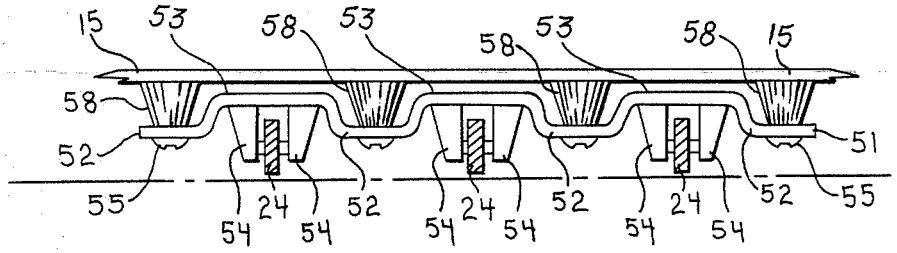
FIG. 4 is a detail side elevation view of part of the FIG. 2 single track segment, with three auxiliary-flooring-section control levers, and their mounting bracket, installed to the underside of the track segment in accordance with the "second embodiment" previously discussed.
Figure 5:
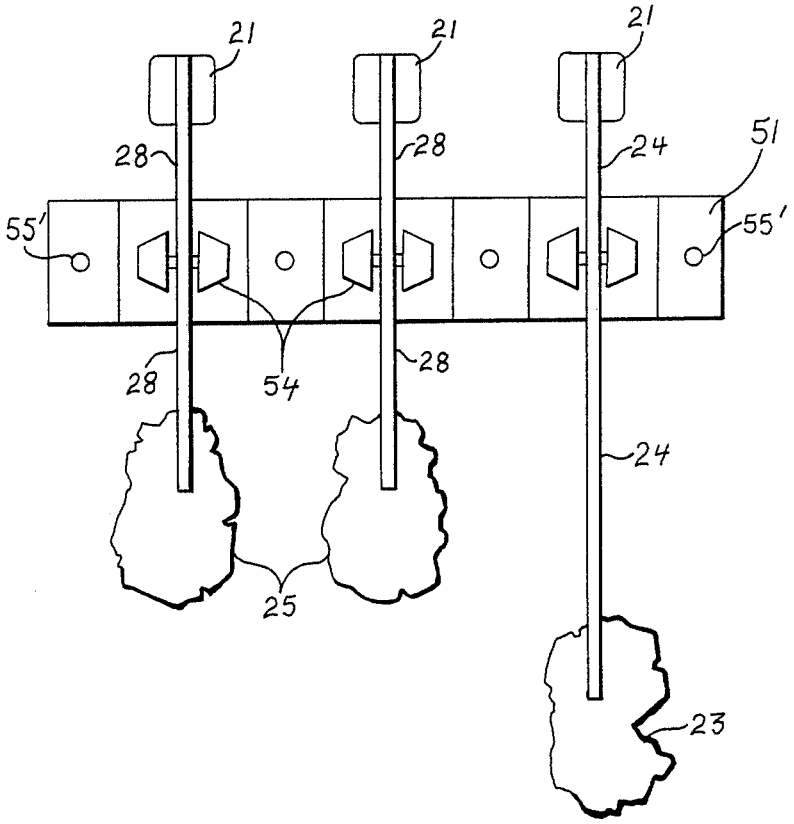
FIG. 5 is a detail bottom plan view of the levers and mounting bracket of FIG. 4, also showing auxiliary flooring sections at the forward ends of the levers.

As FIGS. 4 and 5 show, the auxiliary-flooring control levers are held to the underside of the floor 15 by a bracket 51 which has a shape perhaps best described as "modified undulating": three high sections 53 separate four low sections 52, but at least the four low sections 52 are all essentially flat, to properly accommodate the four self-tapping mounting screws which pass through the bracket 51 and into the holes 59 (FIG. 3) in the mounting bosses 58.

The levers 24 and 28 are pivotally held in fulcrum yokes 54, and as shown in FIG. 5 extend outwardly from the track to the handles 21, and inwardly under the track-segment floor 15 to vertical lever sections and thereby to the auxiliary-flooring means 23 and 25. If desired, each of the levers 24 and 28 can be unsnapped from their respective fulcrum yokes 54 and placed in other fulcrum yokes, so that the order of the long lever 24 and short levers 28 can be selected by the user. The undulatory form of the bracket 51 permits the fulcrum yokes 54 to be located upwardly within the spaces between the pairs of mounting bosses 58 in the track-floor underside, so that the levers 24 and 28 clear the supporting surface 33.

Figure 6:
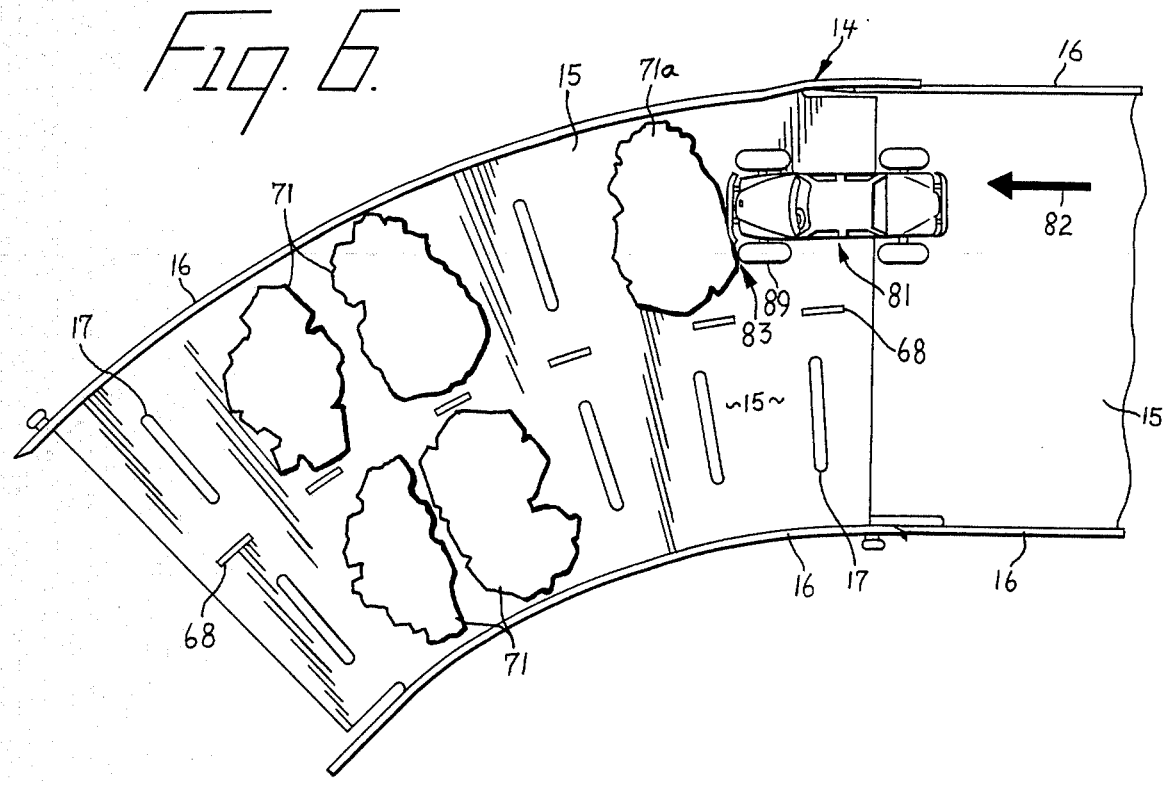
FIG. 6 is a top plan view of a single track segment similar to that of FIG. 2, but with several vehicle-redirecting bumps installed according to the "first embodiment" previously discussed. This drawing also shows a vehicle approaching and just touching one of the bumps.
Figure 7:
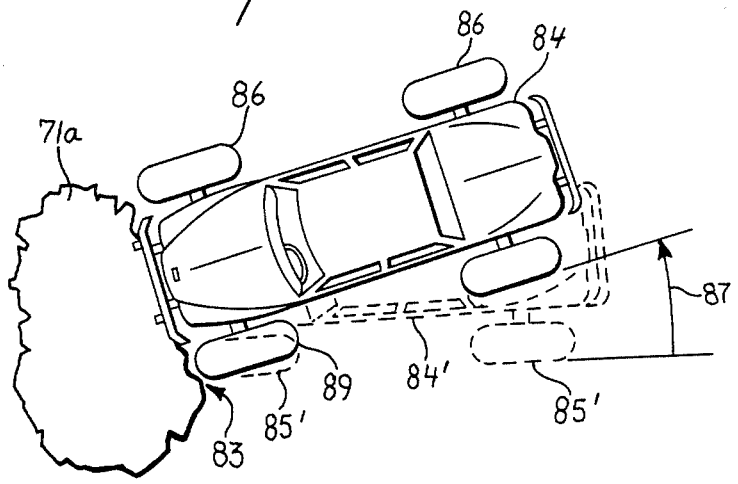
FIG. 7 is an enlarged diagrammatic plan view of part of FIG. 6, but showing the vehicle and diagramming its motion after it has been in contact with the said one bump briefly.

As shown in FIGS. 6 and 7, when a vehicle 81 approaches a particular bump 71*a* on a curved segment 14, as along line of motion 82 from an adjoining segment, the vehicle first fails (as illustrated) to follow the curve of the track, until the inside front wheel 89 reaches the leading edge of the bump 71*a*, at intersection point 83. The bump 71*a* then presents considerably greater resistance to forward motion of that wheel 89 than does the floor 15 of the track to forward motion of any of the other wheels 85 and 86 (FIG. 7). Consequently the outside wheels 86 propel the outside side of the vehicle (the right side in this example) forwardly toward the bump 71*a*, while the inside (left) front wheel remains generally impeded at the point 83 previously established.

The vehicle thus rotates from the position shown in FIG. 6—which in FIG. 7 is the position 84', with wheels at 85', shown in the phantom line—generally through an arc 87 toward the position 84, with wheels at 85, shown in the solid line in FIG. 7. This rotation normally continues until both front wheels engage the bump 71*a*; at that point there is no longer any preferability to sliding rotation over climbing the bump, and the vehicle proceeds forwardly. If the vehicle does not completely "square" against the bump, the same effect at the rear wheels tends to complete the rotation.

Figure 10:
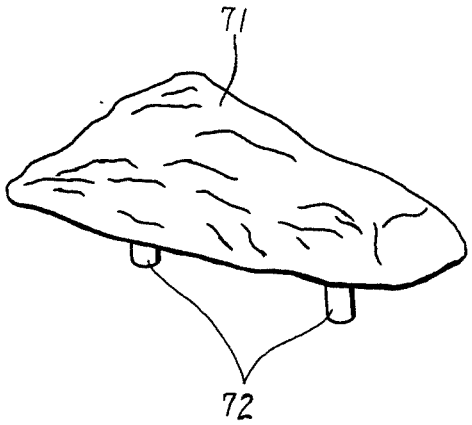
FIG. 10 is a general perspective view of a "bump" in accordance with the "first embodiment".

At each succeeding bump the effect is repeated. FIG. 10 shows that each bump 71 is preferably a discrete, transversely elongated component, having two downwardly extending pins adapted to fit in the transverse holes 17 (FIGS. 1 through 3) in the track-segment floor. Thus each bump can be placed in each slot with a choice of two orientations.

Some of the bumps are advantageously made narrower at one end than at the other. The vehicle-redirecting effect is exaggerated by locating the bumps with their narrow ends toward the outside of the curve, and minimized by locating the bumps with their narrow ends toward the inside of the curve.

Figure 8:
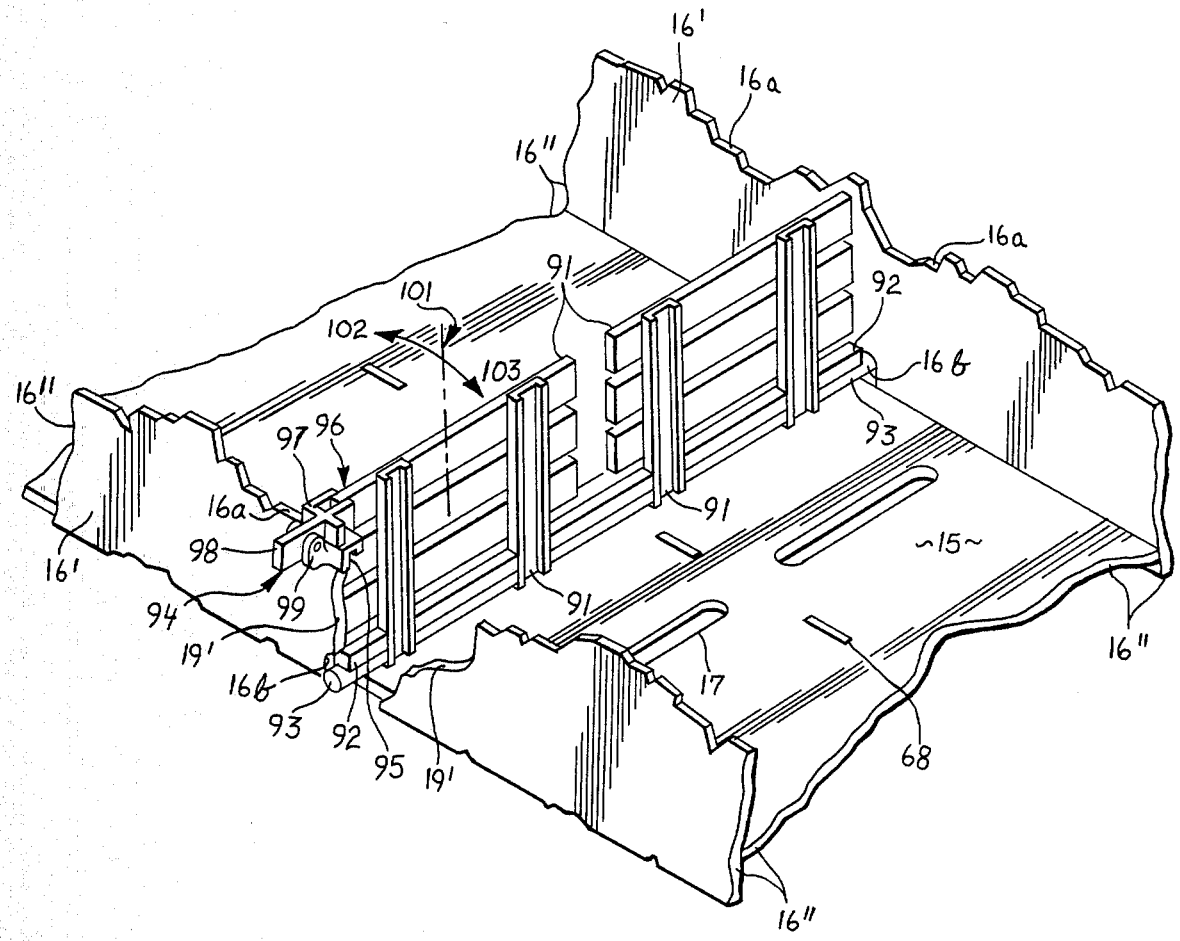
FIG. 8 is a general perspective view of an additional track segment with a starting gate and releasable catch, mentioned as the "fifth embodiment" in the previous discussion.

As shown in FIG. 8, the starting gate 91, 92 is suitably formed to appear as a gate, and has pivot pins 93 formed in the ends of its bottom portion. The pivot pins 93 are fitted into round clearance holes 16*b* in the side walls 16'. (The illustrated track segment here is cut off at 16'' to maintain suitable scale.) The plane of the gate, designated generally by line 101, rotates about the pivot pins 93 either upward, in the direction indicated by arrowhead 103, toward an upright position in which it restrains vehicles on the track; or downward, as indicated by arrowhead 102, toward a flat position in which it permits such vehicles to proceed along the track. When in the upright position the gate 91, 92 can be held in place by a releasable catch 94. The catch is mounted by an inverted clip 95 to a recess 16*a* formed in the top of one side wall 16'. Pivoted (on pin 99) to the clip 95 is a lever 97. The lever has a notch 96 at its inboard end, for capturing the side of the gate; and has a handle 98 at its outboard end, to be depressed by a user when the user wishes to release the gate and let the vehicles proceed.

It is to be understood that all of the foregoing detailed descriptions are by way of example only, and not to be taken as limiting the scope of our invention—which is expressed only in the appended claims.

We claim:

1. A modular toy track for use on a supporting surface, and for use with a self-propelled toy vehicle that is adapted to operate on the track; and comprising:

a first track segment having a floor which defines a plurality of holes, at least part of which floor is spaced above such supporting surface;

a plurality of levers, each pivotally mounted to the track segment and having a handle extending laterally from the track segment for manipulation by a user, and each extending into the region between the floor and such supporting surface, and each being exposed at a corresponding one of the holes; and auxiliary flooring means fixed to or formed in each lever and generally vertically movable by that lever through the said corresponding hole, to vary the effective level of the auxiliary flooring means at that hole and thereby to variably affect the progress of such a vehicle along the track segment in dependence upon such manipulation of the corresponding lever handle by such a user;

a multiplicity of other track segments having walls at both sides but having substantially no floor, so that such vehicle when in any of the said other track segments operates substantially on such supporting surface;

means for interconnecting the other track segments with one another and with the first track segment;

whereby a user of the first track segment may cause such toy vehicle in negotiating the entire track to pass along the first track segment and also to pass along a multiplicity of the other track segments wherein such vehicle operates substantially on such supporting surface.

2. The modular toy track of claim 6, also comprising:

a multiplicity of additional track segments having floors as well as walls; and means for interconnecting the additional track segments respectively with the first track segment or the other track segments.

3. The toy track of claim 2, further adapted for providing continuously adjustable but firmly secured vertical angles between track segments; wherein:

the first segment and the additional segments each have a respective floor, and at each side of the floor a respective wall;

a half hinge at each end of each track segment, the half hinges being formed so that any two track segments can be connected together for relative rotation, by mating the half hinge at one end of one of the two segments with the half hinge at one end of the other of the two segments;

each said wall defining a curved slot at one of its ends and a hole at the other of its ends, the slots and holes being disposed in such a way that when the half hinges of two segments are mated the two segments can be relatively rotated, vertically, into a range of relative vertical angular positions wherein the hole in the wall of one segment is aligned with a point along the curved slot in the other segment; and a plurality of bolts each adapted to pass through one mutually aligned hole and the corresponding curved slot, and mating nuts adapted to be tightened on said bolts to lock each adjacent pair of segment walls in a particular relative vertical angular position.

4. The toy track of claim 1, in combination with such a self-propelled toy vehicle.

5. The toy track of claim 2, in combination with such a self-propelled toy vehicle.

6. The toy track of claim 3, in combination with such a self-propelled toy vehicle.

7. A toy track for use on a supporting surface, and for use with a self-propelled toy vehicle that has a plurality of front wheel means and that is adapted to operate on the track and that depends exclusively upon interaction between the track and the vehicle wheels for guidance and depends exclusively upon the user of the toy track and vehicle for starting-and-stopping control; and comprising:

an elongated track having a floor and having a wall at each side of the floor, said floor defining a plurality of holes and being at least in part spaced above such supporting surface; at least some portions of the track being curved horizontally so that such vehicle when operating on the track must negotiate curves;

a plurality of levers, each adapted to be pivotally mounted to the track and having a handle extending laterally for manipulation by a user, and each lever when so mounted extending into the region between the floor and such supporting surface, and each lever when so mounted being exposed at a corresponding one of the holes;

an irregular bump fixed to or formed in each lever when that lever is so mounted, and generally vertically movable by that lever through the said corresponding hole when that lever is so mounted to vary the height of the bump above the floor at that hole in such a way as to erratically interfere with the wheels and chassis of such vehicle and to erractically perturb the progress of such a vehicle along the track to an extent which varies in dependence upon such manipulation of the corresponding lever handle by such a user; and means for redirecting such vehicle at certain curved portions of the track by selectively impeding the inside wheel means so that such vehicle tends to negotiate those certain curved portions of the track without striking the wall at the outside of those curved portions;

the redirecting means including transversely extended bumps on the floor of those certain curved portions of the track, and the bumps being discrete components, positionable by the user of the toy track at any of the positions where holes are defined in the floor of the track, except those positions where the levers when so mounted are exposed, the holes being adapted to receive and secure the bump components; and whereby the user of the toy track may arbitrarily choose such selectable positions for the bumps, from among any of the multiplicity of positions where there are holes defined in the floor of the track.

8. The toy track of claim 7, wherein:

a plurality of the levers is so mounted with their respective handles extending laterally from the track, and with their respective portions extending into the region between the floor and the supporting surface and exposed through a first certain plurality of the holes; and a plurality of the bumps is so positioned at a second certain plurality of the holes, and is received and secured thereby.

9. The toy track of claim 8, wherein:

the first and second certain pluralities of the holes are mutually exclusive.

10. The toy track of claim 7, in combination with such a self-propelled toy vehicle.

11. The toy track of claim 8, in combination with such a self-propelled toy vehicle.

12. The toy track of claim 9, in combination with such a self-propelled toy vehicle.

* * * * *